US008747169B2

(12) United States Patent
Ito

(10) Patent No.: US 8,747,169 B2
(45) Date of Patent: Jun. 10, 2014

(54) CONNECTOR

(75) Inventor: Yoshitaka Ito, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/559,751

(22) Filed: Jul. 27, 2012

(65) Prior Publication Data

US 2012/0295491 A1 Nov. 22, 2012

Related U.S. Application Data

(63) Continuation of application No. PCT/JP2011/051631, filed on Jan. 27, 2011.

(30) Foreign Application Priority Data

Jan. 28, 2010 (JP) ..... 2010-016616

(51) Int. Cl.
*H01R 13/514* (2006.01)

(52) U.S. Cl.
USPC ..... 439/752; 439/595

(58) Field of Classification Search
USPC ..... 439/595, 701, 752
See application file for complete search history.

(56) References Cited

U.S. PATENT DOCUMENTS

| | | | | |
|---|---|---|---|---|
| 5,997,364 | A | 12/1999 | Matsuoka et al. | |
| 5,997,365 | A * | 12/1999 | Abe | 439/752 |
| 6,083,056 | A * | 7/2000 | Okabe et al. | 439/701 |
| 7,297,032 | B2 * | 11/2007 | Kobayashi et al. | 439/701 |
| 7,500,887 | B2 * | 3/2009 | Ichio | 439/752 |
| 7,556,539 | B2 * | 7/2009 | Takahashi et al. | 439/752 |
| 7,695,315 | B2 * | 4/2010 | Hitchcock et al. | 439/541.5 |
| 7,780,484 | B2 * | 8/2010 | Martin | 439/752 |
| 7,841,913 | B2 * | 11/2010 | Hitchcock et al. | 439/752 |

FOREIGN PATENT DOCUMENTS

| | | | |
|---|---|---|---|
| EP | 0929124 | A1 | 7/1999 |
| EP | 2057714 | A1 | 2/2008 |
| GB | 2432466 | A | 5/2007 |
| JP | 11214063 | A | 8/1999 |
| JP | 2006302752 | A | 11/2006 |
| JP | 200847476 | A | 2/2008 |
| JP | 2010-009801 | A | 1/2010 |
| WO | 2008023009 | A1 | 2/2008 |

OTHER PUBLICATIONS

Written Opinion dated Feb. 22, 2011 issued in International Application No. PCT/JP2011/051631.
International Search Report dated Feb. 22, 2011 issued in International Application No. PCT/JP2011/051631.
Extended European Search Report issued May 28, 2013, in corresponding Application No. 11737101.3.

* cited by examiner

*Primary Examiner* — Thanh Tam Le
(74) *Attorney, Agent, or Firm* — Sughrue Mion, PLLC

(57) ABSTRACT

A connector housing includes an upper housing having a front end wall that defines the front end of a terminal containing chamber, and a lower housing having an opening section due to the lack of a front end wall. The front end wall of the upper housing has an insertion hole. The lower housing has the terminal containing chamber, and is disposed with a lance which is formed by using the opening section on the front end of the lower housing as a through hole. The upper housing and the lower housing have restricting portions which inhibit the relative displacement of both housings in the front and back direction when united, and a locking mechanism for maintaining the united state by restricting the upper housing and lower housing from separating in the upper or lower direction.

4 Claims, 7 Drawing Sheets

CONNECTOR

CROSS REFERENCE TO RELATED APPLICATION

This application is a continuation of PCT application No. PCT/JP2011/051631, which was filed on Jan. 27, 2011 based on Japanese Patent Application (No. 2010-016616) filed on Jan. 28, 2010, the contents of which are incorporated herein by reference. Also, all the references cited herein are incorporated as a whole.

BACKGROUND

1. Technical Field

The present invention relates to a connector for containing a female terminal inside a connector housing and retaining the female terminal by a lance.

2. Background Art

In a connector for containing a female terminal inside a connector housing, generally, the female terminal inserted from the back is retained by a flexible lance formed inside a terminal containing chamber. The connector housing is manufactured by resin molding and in that case, molding of the lance becomes a problem. The normal lance is made of sections necessary to be molded from the back side and the front side of the connector housing by a metallic mold, and the section molded from the front side has a front end wall having an insertion hole (also called a pickup hole for a male terminal) of the male terminal of the mating connector side in the front end of the connector housing, so that the lance is molded by providing its front end wall with through holes for a mold. However, it is not desirable to remain many unnecessary holes which are not required functionally, that is, the through holes in the front end wall of the connector housing.

Hence, for example, JP-A-2006-302752 proposes and discloses a connector constructed so that a part including a front end wall of a connector housing having an insertion hole of a male terminal is constructed of a separate member and a lance of each terminal containing chamber can be molded from the front side of the housing in a state that the front end is opened without the front end wall.

As shown in FIG. 7, in this connector, a connector housing 100 is divided into a housing body 101 whose front end is opened as a recess 105, and a holding member 110 fitted into the recess 105 of the front end of this housing body 101, and the housing body 101 is formed with a terminal containing chamber 102 into which a female terminal 130 is inserted from the back, and a lance 103 for locking the female terminal 130 inserted from the back is formed inside the terminal containing chamber 102. In this case, the front end of the terminal containing chamber 102 is opened toward the recess 105 and the lance 103 is molded by using the recess 105 as molding space. Also, the holding member 110 constructing a front end wall of the connector housing 100 is provided with an insertion hole 112 for guiding the tip of a male terminal 140 so as to be fitted into the female terminal 130 by inserting the male terminal 140 of the mating connector side.

This connector is constructed so that the connector housing 100 is assembled by fitting the holding member 110 into the recess 105 of the front end of the housing body 101 from the front and engaging the holding member 110 and the female terminal 130 is inserted into each of the terminal containing chambers 102 of its connector housing 100 from the back and each of the female terminals 130 is retained by the lance 103.

Incidentally, in the connector described in JP-A-2006-302752 shown in FIG. 7, the front end wall of the connector housing 100 is formed as the holding member 110 separate from the housing body 101, so that the connector can obtain an advantage of eliminating the need to provide the front end wall (the holding member 110) with a through hole of the lance 103, but adopts a configuration in which the holding member 110 is attached and engaged to the recess 105 of the front end of the housing body 101 from the front side, with the result that by an operation etc. in the case of releasing fitting into the mating connector, a force in a direction detached from the housing body 101 acts on the holding member 110 and this may displace or loosen a united state of the holding member 110 and the housing body 101.

SUMMARY

In view of the circumstances described above, an object of the invention is to provide a connector in which a front end wall of a connector housing does not need to be formed with unnecessary holes (a through hole for forming a lance) and also the connector housing is configured as two components, a united state of the connector housing can be prevented from being displaced or loosened to configure the connector housing with high integrity.

In order to solve the problem described above, a first invention is a connector in which plural terminal containing chambers extending in the front and back direction are formed inside a connector housing made of a resin molded article and a female terminal inserted into each of the terminal containing chambers from the back is retained by a flexible lance formed inside the terminal containing chamber, and the connector housing is configured as an integrated article formed from two components constituting a first housing which is integrally provided with a front end wall of the connector housing defining the front end of each of the terminal containing chambers, and a second housing, the front side of which is opened due to the lack of the front end wall, and the front end wall of the first housing is formed with an insertion hole into which the tip of a male terminal of a mating connector is inserted so as to be fitted into the female terminal of the inside of the terminal containing chamber at the time of being fitted into the mating connector, and the second housing is formed with the terminal containing chamber in a state that the front end is opened, and is also disposed with the lance which is molded by using an opening section on the front end of the second housing as a through hole, and the first housing and the second housing can be combined in the upper and lower direction orthogonal to the front and back direction in the case of being united mutually, and the first housing and the second housing are provided restricting convex portion which inhibits the relative displacement of both housings in the front and back direction when united, and a locking mechanism for maintaining the united state by restricting both housings from separating in the upper or lower direction.

A second invention is the connector of the first invention, and the first housing is provided with a double locking portion for doubly locking the female terminal together with the lance in the case of being combined with the second housing.

A third invention is the connector of the first or second invention, and the first housing is an upper housing set in an upper side at the time of combination and the second housing is a lower housing set in a lower side at the time of combination, and the first housing is provided with a locking arm locked in a locking portion of a mating connector housing in the case of being fitted into the mating connector.

According to the first invention, the connector housing is configured as the integrated article formed from two components constituting the first housing and the second housing, and the first housing is formed with the front end wall of the connector housing having the insertion holes into which the male terminals of the mating connector are inserted and also, the lance is formed in the second housing whose front end is opened due to the lack of the front end wall, so that the need to form the front end wall of the connector housing with a through hole for forming a lance can be eliminated. Therefore, a situation in which many through holes are left in the front end wall of the connector housing due to an increase in the number of terminals per area of the front end wall of the connector housing with miniaturization of the connector can be avoided. Also, the front end wall of the connector housing has no through hole for forming the lance and thereby, the tip of the male terminal at the time of connector fitting can be prevented from being inserted into the through hole by mistake, and connector fitting can become smooth.

Also, the first housing and the second housing in this case are combined and united in the upper and lower direction, and the first housing and the second housing are provided with the restricting portion which inhibits the relative displacement of both housings in the front and back direction when united, and the locking mechanism for locking both housings in the upper and lower direction, so that the united state of the first housing and the second housing can be prevented from being displaced or loosened by a release manipulation etc. along the front and back direction in the case of releasing fitting into the mating connector, and though the two components are combined and united, integrity of the connector housing can be maintained strongly.

According to the second invention, the female terminal inserted into the terminal containing chamber of the second housing from the back can be locked by the double locking portion formed in the first housing together with the lance formed in the terminal containing chamber, so that reliability of terminal holding can be improved.

According to the third invention, the first housing integrally provided with the front end wall of the connector housing has the locking arm, so that the locking arm can be formed longer with room from a position of the front end wall of the connector housing. By the way, when the second housing without the front end wall is provided with the locking arm, the locking arm cannot be formed from the position of the front end wall due to the lack of the front end wall and therefore, the length of the locking arm cannot be ensured with room, but when the first housing has the locking arm as shown in the third invention, the locking arm can be formed with room for length. Therefore, the locking arm can be provided with sufficient flexibility.

DETAILED DESCRIPTION OF THE EXEMPLARY EMBODIMENTS

An embodiment of the invention will hereinafter be described with reference to the drawings.

Figure 1:
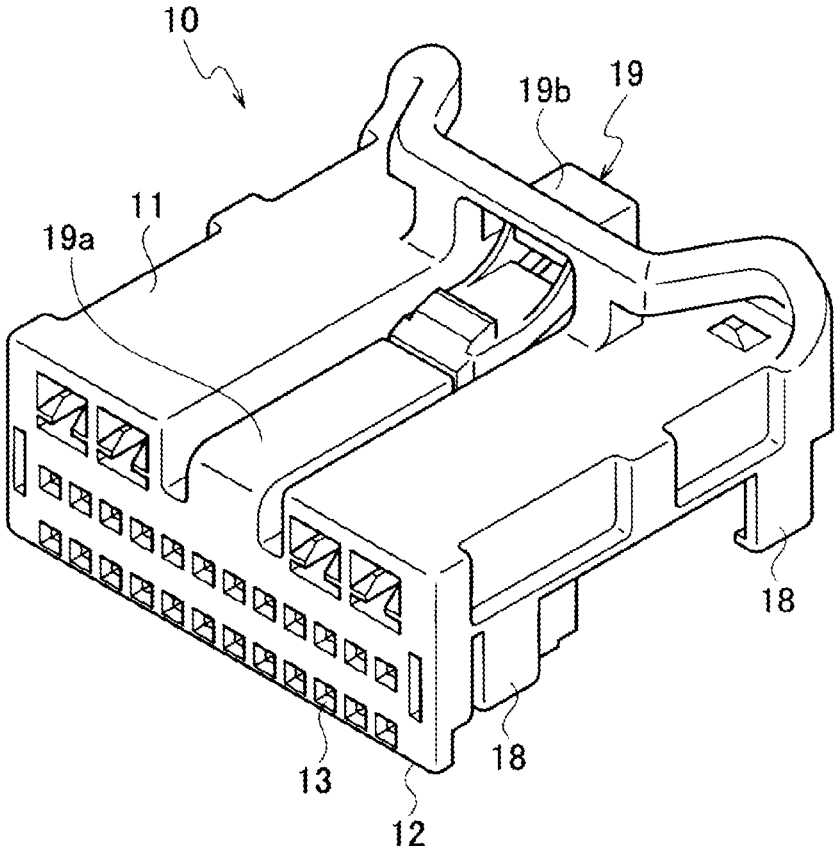
FIG. 1 is an appearance perspective view showing an upper housing (first housing) which is a component of a connector according to an embodiment of the invention.
Figure 2:
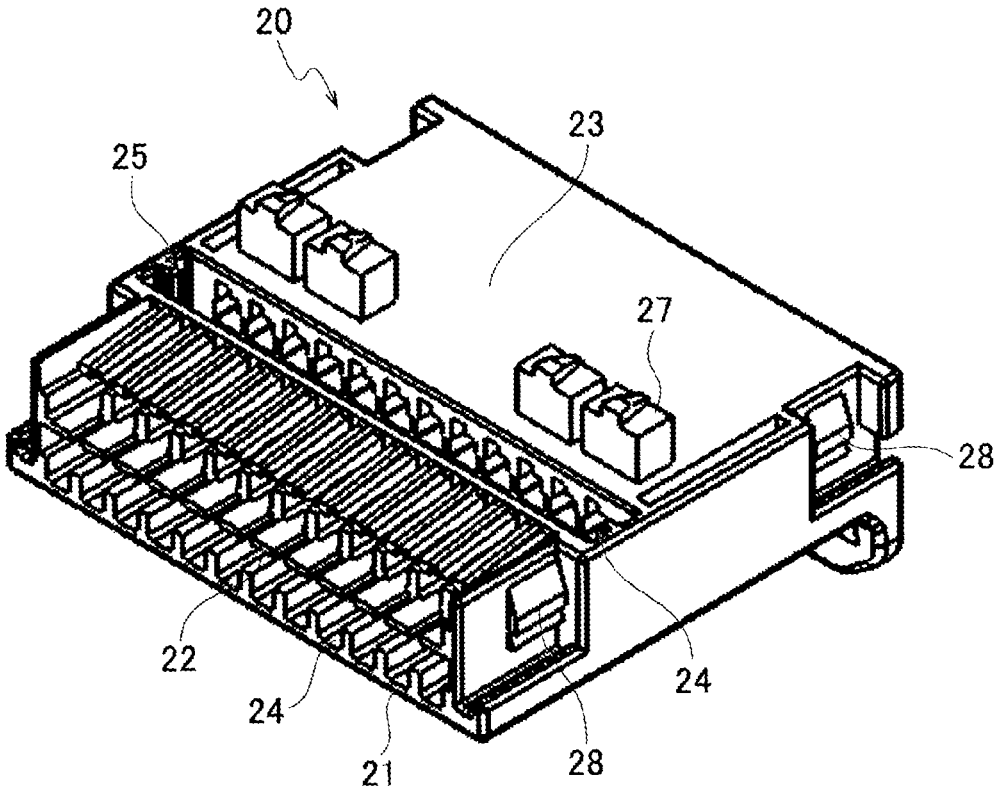
FIG. 2 is an appearance perspective view showing a lower housing (second housing) which is a component of the same connector.
Figure 3:
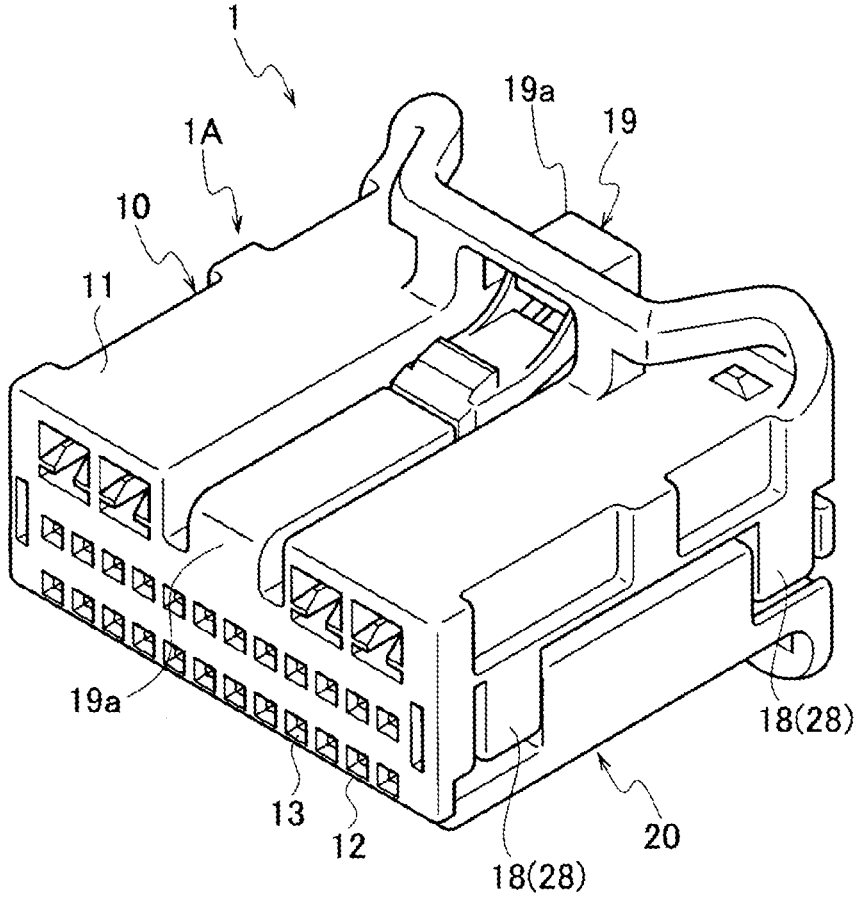
FIG. 3 is an appearance perspective view showing a completion state of the same connector.
Figure 4:
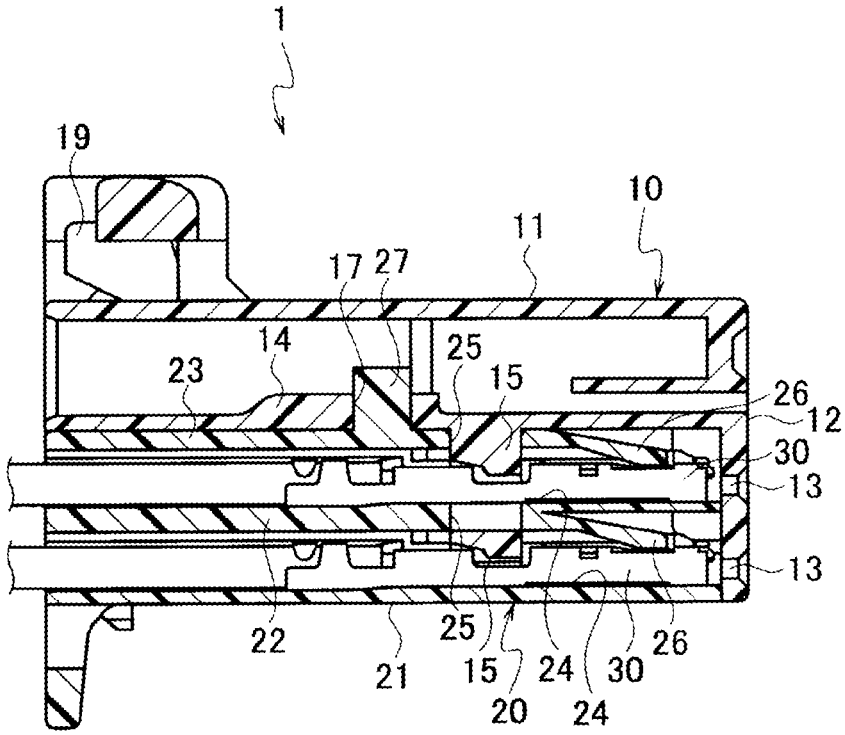
FIG. 4 is a sectional side view of the connector in the completion state of FIG. 3.
Figure 5:
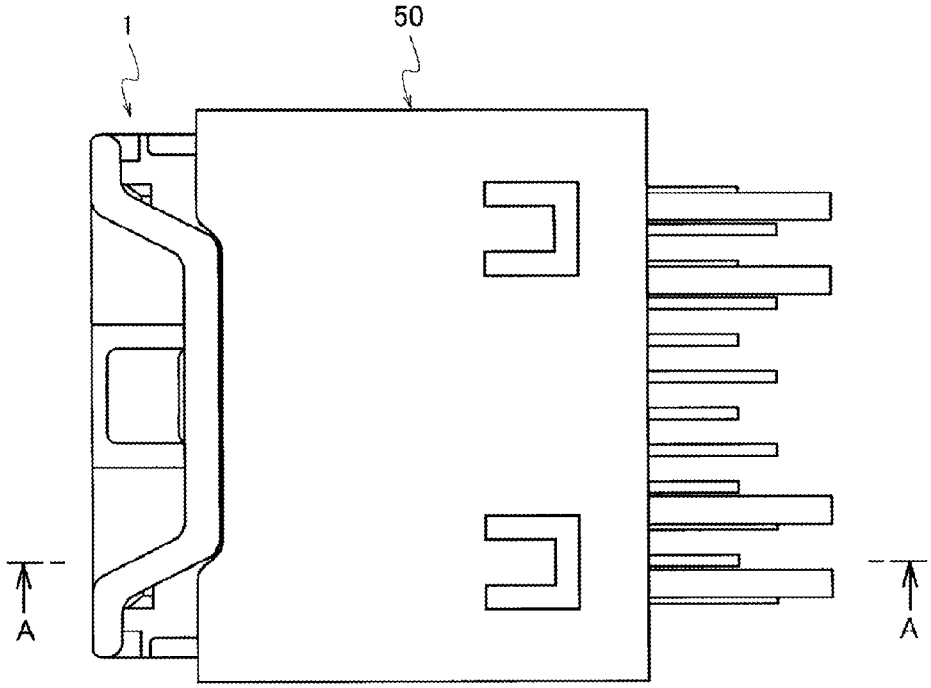
FIG. 5 is a plan view showing a state in which the same connector is fitted into a mating connector.
Figure 6:
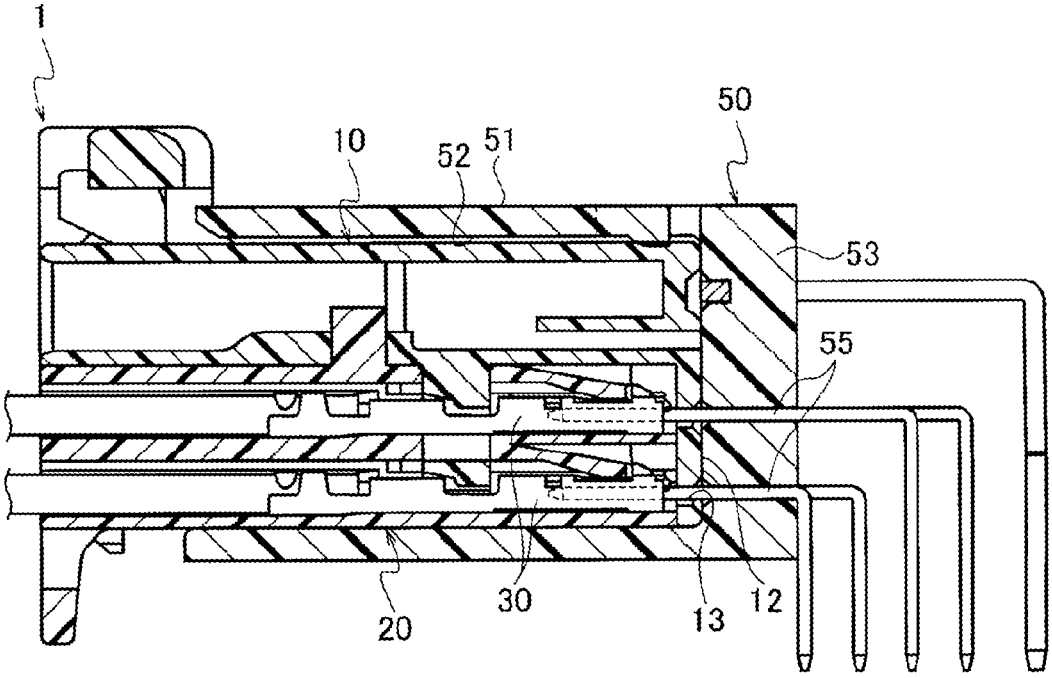
FIG. 6 is a sectional view taken on arrow A-A of FIG. 5.
Figure 7:
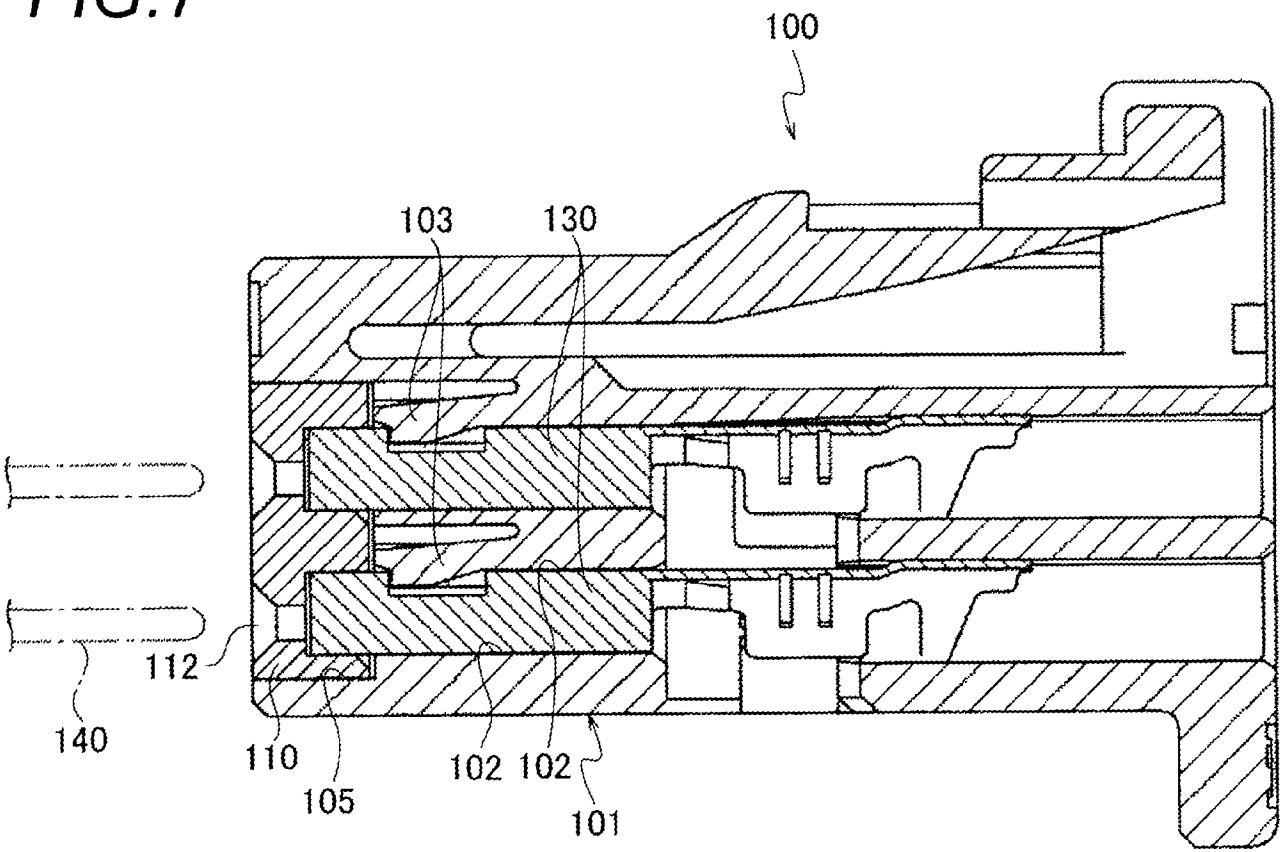
FIG. 7 is a sectional side view showing a configuration of a conventional connector.

FIG. 1 is an appearance perspective view showing an upper housing (first housing) which is a component of a connector of the embodiment, and FIG. 2 is an appearance perspective view showing a lower housing (second housing), and FIG. 3 is an appearance perspective view showing a completion state of the connector, and FIG. 4 is a sectional side view of the connector in the completion state, and FIG. 5 is a plan view showing a state in which the connector of the embodiment is fitted into a mating connector, and FIG. 6 is a sectional view taken on arrow A-A of FIG. 5.

As shown in FIGS. 3 and 4, in this connector 1, a female terminal 30 is contained inside each terminal containing chamber 24 of a connector housing 1A made of a resin molded article. The terminal containing chambers 24 respectively extend in the front and back direction of the connector housing 1A and are formed in two vertical stages, and each of the terminal containing chambers 24 is formed with a flexible lance 26 for retaining the female terminal 30 inserted from the back.

The connector housing 1A in this embodiment is configured as an integrated article formed from two components constituting an upper housing (first housing) 10 and a lower housing (second housing) 20. The upper housing is integrally provided with a front end wall 12 of the connector housing defining the front end of each of the terminal containing chambers 24. The front side of the lower housing 20 is opened due to the lack of the front end wall 12. The upper housing 10 and the lower housing 20 are configured combinably in the upper and lower direction orthogonal to the front and back direction in the case of being united mutually, and the upper housing 10 is set in the upper side and the lower housing 20 is set in the lower side at the time of combination of them.

In the upper housing 10 shown in FIG. 1, the front end wall 12 is continuously and downwardly extended in the front end of an upper wall 11, and the front end wall 12 is formed with an insertion hole 13 into which the tip of a male terminal 55 of a mating connector 50 is inserted so as to be fitted into the female terminal 30 in the terminal containing chamber 24 at the time of being fitted into the mating connector 50 as shown in FIG. 6. Also, on an upper surface of the upper wall 11 of the upper housing 10, a locking arm 19 locked in a locking portion (not shown) of a mating connector housing 51 in the case of being fitted into the mating connector 50 is formed in the form of a cantilever arm in which a proximal end 19*a* as a fixed end is positioned in a position of the front end wall 12 and a distal end 19*b* as a free end is backward extended from the proximal end 19*a*.

Also, in the lower housing 20 shown in FIG. 2, a lower stage wall 21, a middle stage wall 22 and an upper stage wall 23 are spaced in the upper and lower direction, and horizontal arrangement of the terminal containing chambers 24 of each stage is formed between the lower stage wall 21 and the middle stage wall 22 and between the middle stage wall 22 and the upper stage wall 23, respectively. By providing the front end wall 12 on the upper housing 10, each of the terminal containing chambers 24 is formed in the form in which the front end is opened, and the lance 26 having flexibility in the upper and lower direction by using an opening section on the front end as a through hole is molded inside each of the terminal containing chambers 24 as shown in FIG. 4.

Also, as shown in FIG. 4, the upper stage wall 23 and the middle stage wall 22 of the lower housing 20 are formed with openings 25 into which double locking portions 15 formed on a lower surface of the upper housing 10 are slidably inserted. Also, a position of the back side beyond a position in which the opening 25 of the upper stage wall 23 is formed is provided restricting convex portion convex portion (a restricting portion) 27 fitted into a restricting concave portion 17 formed on the lower surface of the upper housing 10.

Then, in a united state of the upper housing 10 and the lower housing 20, the double locking portion 15 of the upper housing 10 entering the inside of the terminal containing chamber 24 through the opening 25 of the lower housing 20 engages with a recess of the female terminal 30 and thereby, the female terminal 30 is doubly locked in addition to locking by the lance 26. Also, in the united state of the upper housing 10 and the lower housing 20, the restricting convex portion 27 of the lower housing 20 is fitted into the restricting concave portion 17 of the upper housing 10 and thereby, relative displacement of both housings 10, 20 in the front and back direction is inhibited.

Also, the upper housing 10 and the lower housing 20 are provided with locking claws 18 and locking convex portions 28 (locking mechanisms) for maintaining the united state by restricting both housings 10, 20 from separating in the upper or lower direction by mutually engaging in the case of properly combining both housings 10, 20 in the upper and lower direction.

When this connector 1 is assembled, the upper housing 10 is assembled to the lower housing 20 from the upper side. When the upper housing 10 is assembled halfway, the double locking portions 15 are maintained just before the double locking portions 15 enter the terminal containing chambers 24. In this state, the female terminal 30 is inserted into each of the terminal containing chambers 24 of the lower housing 20 from the back. When the female terminal 30 is inserted deeply, the lance 26 pushed by the female terminal 30 flexes once and returns to the original state and thereby, the female terminal 30 is locked so as not to come out backward. In this state, the upper housing 10 is completely assembled to the lower housing 20. Then, the restricting convex portion 27 is fitted into the restricting concave portion 17 and thereby, both housings 10, 20 are coupled so as not to move relatively in the front and back direction. Also, the double locking portion 15 engages with the recess of the female terminal 30 and thereby, the female terminal 30 is doubly locked. Also, the locking claws 18 engage with the locking convex portions 28 and thereby, the upper housing 10 is locked in the lower housing 20 so as not to be detached in the upper or lower direction. Consequently, the connector 1 is completed.

When this connector 1 is connected to the mating connector 50 as shown in FIGS. 5 and 6, the connector housing 1A is fitted into a fitting concave portion 52 of the connector housing 51 of the mating connector 50. Then, the tips of the male terminals 55 maintained in a back wall portion of the mating connector housing 51 are respectively inserted into the insertion holes 13 of the front end wall 12 of the upper housing 10 constructing the connector housing 1A and are fitted into the female terminals 30 maintained inside the terminal containing chambers 24. Consequently, connection between the connectors 1, 50 is established.

According to this connector 1 as described above, the connector housing 1A is configured as the integrated article formed from two components constituting the upper housing 10 and the lower housing 20, and the upper housing 10 is formed with the front end wall 12 of the connector housing having the insertion holes 13 into which the male terminals 55 of the mating connector 50 are inserted and also, the lance 26 is formed in the lower housing 20 whose front end is opened due to the lack of the front end wall 12, so that the need to form the front end wall 12 of the connector housing with a through hole for forming a lance can be eliminated. Therefore, a situation in which many through holes are remained in the front end wall 12 of the connector housing due to an increase in the number of terminals per area of the front end wall 12 of the connector housing 1A with miniaturization of the connector 1 can be avoided. Also, the front end wall 12 of the connector housing has no through hole for forming the lance and thereby, the tip of the male terminal 55 at the time of connector fitting can be prevented from being inserted into the through hole by mistake, and connector fitting can become smooth.

Also, the upper housing 10 and the lower housing 20 in this case are combined and united in the upper and lower direction, and the upper housing 10 and the lower housing 20 are provided with the restricting portions (the restricting convex portion 27 and the restricting concave portion 17) which inhibit the relative displacement of both housings 10, 20 in the front and back direction when united, and the locking mechanisms (the locking claws 18 and the locking convex portions 28) for locking both housings 10, 20 in the upper and lower direction, so that the united state of the upper housing 10 and the lower housing 20 can be prevented from being displaced or loosened by a release manipulation etc. along the front and back direction in the case of releasing fitting into the mating connector 50, and though the two components are combined and united, integrity of the connector housing 1A can be maintained strongly.

Also, the female terminal 30 inserted into the terminal containing chamber 24 of the lower housing 20 from the back can be locked by the double locking portion 15 formed in the upper housing 10 together with the lance 26 formed in the terminal containing chamber 24, so that reliability of terminal holding can be improved.

Also, the upper housing 10 integrally provided with the front end wall of the connector housing is provided with the locking arm 19, so that the locking arm 19 can be formed longer with room from a position of the front end wall 12 of the connector housing. By the way, when the lower housing 20 without the front end wall 12 is provided with the locking arm 19, the locking arm cannot be formed from the position of the front end wall 12 due to the lack of the front end wall 12 and therefore, the length of the locking arm cannot be ensured with room, but when the upper housing 10 is provided with the locking arm 19 as shown in the connector of the embodiment, the locking arm 19 can be formed with room for length, so that the locking arm 19 can be provided with sufficient flexibility.

The invention has been described in detail with reference to the specific embodiment, but it is apparent to those skilled in the art that various changes or modifications can be made without departing from the spirit and scope of the invention.

What is claimed is:

1. A connector comprising:

a connector housing made of a resin molded article; and plural terminal containing chambers that extend in a front and back direction and are formed inside the connector housing, female terminals being inserted into the terminal containing chambers from a back and retained by flexible lances formed inside the terminal containing chambers, wherein the connector housing is configured as an integrated article formed from two components constituting a first housing and a second housing;

wherein the first housing is integrally provided with a front end wall of the connector housing defining a front end of each of the terminal containing chambers, and a front side of the second housing is opened due to the lack of the front end wall;

wherein the front end wall of the first housing has insertion holes into which tips of male terminals of a mating connector are inserted so as to be fitted into the female terminals in the terminal containing chambers at the time of being fitted into the mating connector;

wherein the terminal containing chambers are formed in the second housing in a state that the front end of each of the terminal containing chambers is opened, and the lances are formed so as to be molded by using opening section on the front end of each of the terminal containing chambers as a through hole; and wherein the first housing is provided with a restricting concave portion which is fitted into a restricting convex portion projecting from a top surface of the second housing and the second housing are able to be combined with the first housing in an upper and lower direction orthogonal to the front and back direction in the case of being united mutually, and the restricting convex portion and the restricting concave portion inhibits a relative displacement of the first and second housings in the front and back direction when united, and the first housing and second housings have a locking mechanism for maintaining the united state by restricting the first and second housings from separating in the upper and lower direction.

2. The connector according to claim 1, wherein the first housing is provided with double locking portions for doubly locking the female terminals together with the lances in the case of being combined with the second housing.

3. The connector according to claim 1, wherein the first housing is an upper housing arranged in an upper side at the time of an assemble and the second housing is a lower housing arranged in a lower side at the time of the assemble; and wherein the first housing is provided with a locking arm locked in a locking portion of a mating connector housing in the case of being fitted into the mating connector.

4. The connector according to claim 1, wherein the terminal containing chambers are formed only in the second housing.

* * * * *